US008948919B2

(12) United States Patent
Yabuta et al.

(10) Patent No.: US 8,948,919 B2
(45) Date of Patent: Feb. 3, 2015

(54) AIR-CONDITIONING APPARATUS

(75) Inventors: Atsuhiro Yabuta, Chiyoda-ku (JP); Kenji Matsui, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 450 days.

(21) Appl. No.: 13/258,229

(22) PCT Filed: Apr. 22, 2009

(86) PCT No.: PCT/JP2009/057971
§ 371 (c)(1),
(2), (4) Date: Sep. 21, 2011

(87) PCT Pub. No.: WO2010/122640
PCT Pub. Date: Oct. 28, 2010

(65) Prior Publication Data
US 2012/0017619 A1 Jan. 26, 2012

(51) Int. Cl.
*G05D 23/00* (2006.01)
*F24F 11/02* (2006.01)
*F24F 11/00* (2006.01)

(52) U.S. Cl.
CPC ..... *F24F 11/0009* (2013.01); *F24F 2011/0047* (2013.01); *F24F 2011/0075* (2013.01); *F24F 2011/0094* (2013.01)
USPC ..... 700/276; 62/129

(58) Field of Classification Search
USPC ..... 700/276–278, 296; 236/51; 323/351; 62/129; 165/11.1
See application file for complete search history.

(56) References Cited

U.S. PATENT DOCUMENTS

| | | | | |
|---|---|---|---|---|
| 4,049,044 | A | 9/1977 | Cohen | |
| 6,874,691 | B1 * | 4/2005 | Hildebrand et al. | 236/51 |
| 2007/0043478 | A1 | 2/2007 | Ehlers et al. | |
| 2008/0209927 | A1 | 9/2008 | Igarashi et al. | |

(Continued)

FOREIGN PATENT DOCUMENTS

| | | | |
|---|---|---|---|
| EP | 1 950 505 | A2 | 7/2008 |
| JP | 5-133590 | A | 5/1993 |

(Continued)

OTHER PUBLICATIONS

First Office Action dated Aug. 5, 2013, issued by the Chinese Patent Office in corresponding Chinese Patent Application No. 200980158840.8, and an English Translation of the Office Action. (12 pages).

International Search Report (PCT/ISA/210) issued on Jul. 21, 2009, by Japanese Patent Office as the International Searching Authority for International Application No. PCT/JP2009/057971.

Office Action (Notice of Reasons for Rejection) dated Oct. 23, 2012, issued by the Japanese Patent Office in the corresponding Japanese Patent Application No. 2011-510116 and an English translation thereof. (2 pages).

(Continued)

*Primary Examiner* — Sean Shechtman
*Assistant Examiner* — Steven Garland
(74) *Attorney, Agent, or Firm* — Buchanan Ingersoll & Rooney PC

(57) ABSTRACT

There are provided an electric energy meter with a transmission device that generates a pulse signal for measuring electric energy supplied to an outdoor unit, an input circuit for an external signal that receives the pulse signal, and a control unit that measures electric energy on the basis of the pulse signal, wherein the control unit includes a determination unit that determines, as an input port for the pulse signal, one of input ports that are not in use from among a plurality of input ports forming the input circuit for an external signal, and a calculation unit that calculates electric power, electric energy consumption, and energy consumption efficiency on the basis of the pulse signal.

8 Claims, 13 Drawing Sheets

(56) References Cited

U.S. PATENT DOCUMENTS

| | | | | |
|---|---|---|---|---|
| 2011/0153090 | A1* | 6/2011 | Besore et al. | 700/278 |
| 2012/0123594 | A1* | 5/2012 | Finch et al. | 700/278 |

FOREIGN PATENT DOCUMENTS

| | | | |
|---|---|---|---|
| JP | 5-336797 | A | 12/1993 |
| JP | 2002-156142 | A | 5/2002 |
| WO | WO 2007/032065 | A1 | 3/2007 |

OTHER PUBLICATIONS

Extended European Search Report dated Dec. 3, 2012, issued by the European Patent Office in the corresponding European Application No. 09843640.5. (6 pages).

Mar. 21, 2014 Chinese Office Action issued in Chinese Patent Application No. 200980158840.8.

* cited by examiner

FIG. 5B (*1) CONSTANTLY PERFORMED WHILE THE POWER SUPPLY IS ON.
(*2) PERIODICALLY (FOR EXAMPLE, EVERY 30 sec) PERFORMED.
(*3) COP IS CALCULATED FROM WHEN THE CENTRALIZED CONTROLLER PERFORMS THE COP MEASUREMENT COMMAND.
(*4) The electric power, the amount of power consumption, and COP are transmitted when the centralized controller issues amount of electric power transmission command.

(*1) FOR EXAMPLE, WITHIN 300 msec
(*2) FOR EXAMPLE, 1 sec OR MORE
(*3) FOR EXAMPLE, TWO TIMES
(*4) FOR EXAMPLE, 10 MINUTES OR MORE

AIR-CONDITIONING APPARATUS

TECHNICAL FIELD

The present invention relates to an air-conditioning apparatus and, more particularly, relates to an electric power measurement method using an electric energy meter with a pulse transmission device in an air-conditioning apparatus.

BACKGROUND ART

There has been a wide demand for activities to improve energy saving in facilities as stipulated by EPBD (Energy Performance of Buildings Directive) "Europe directive relating to energy performance improvement of buildings" in Europe and the national energy saving law, and there is a case in which the measurement and the display of power consumption of apparatuses are demanded in those activities.

Accordingly, in a conventional air-conditioning apparatus disclosed in Patent Literature 1, described below, when measuring power consumption, a pulse signal transmitted from an electric energy meter with a pulse transmitting device (described as an electric energy meter, in some instances, hereinafter), which is arranged between an outdoor unit and an indoor unit, and the commercial power supply, will be imported by a dedicated electric energy meter connection circuit that is provided in the outdoor unit, to accumulate and calculate its electric energy.

And, there is a method to calculate the consumed electric power with the acquired sensor value which the outdoor unit holds, when the electric energy meter is not used, the method in which the electric power of the outdoor unit is calculated from calculated input electric powers of a compressor, a fan, and an inverter, respectively (see, for example, Patent Literature 2).

CITATION LIST

Patent Literature

Patent Literature 1: International Publication WO2007/032065 A1 pamphlet (pages 4 to 5, FIG. 2)

Patent Literature 2: Japanese Unexamined Patent Application Publication No. 5-133590 (page 3, FIG. 1)

SUMMARY OF INVENTION

Technical Problem

However, in the method of measuring the amount of electric energy consumption of the air-conditioning apparatus disclosed in Patent Literature 1 described above, a pulse signal information transmitted from an electric energy meter is collected by a control unit of an outdoor unit through dedicated signal reception means (electric energy meter connection circuit), thus requiring a special circuit apart from a control portion. Further, when a pulse signal transmitted from the electric energy meter is disturbed by external noise and the control unit of the outdoor unit can not recognize the pulse signal, a problem in that the electric energy cannot be measured with high accuracy occurs. And further, when the electric energy meter is not used, a problem of poor accuracy occurs. For comparison, in a method in which an electric energy meter is not used, accuracy is poor in such that the error is from 10 to 20%, whereas in a measuring method in which an electric energy meter is used, the error is from 1 to 3%.

The present invention has been achieved to solve the above-described problems, and the first object thereof is to obtain an air-conditioning apparatus which can calculate the electric power consumption without requiring a special dedicated communication circuit to receive a pulse signal transmitted from the electric energy meter, by adding to the conventional input circuit that receives a control signal from the air-conditioning apparatus a function of discriminating the control signal and the pulse signal from the electric energy meter.

The second object of the present invention is to obtain an air-conditioning apparatus, with a multi-outdoor equipment having multiple outdoor units, that can prevent dropout of data when there is an outdoor unit that can not receive the pulse signal from the electric energy meter, by calculating the electric energy of the mentioned outdoor unit that can not receive the signals from operation information of the mentioned outdoor unit and from electric power and operation information of the other outdoor units.

The third object of the present invention is to obtain an air-conditioning apparatus that can calculate electric power, electric energy consumption, and energy consumption efficiency (Coefficient Of Performance (hereinafter, described as COP, in some instances)) with high accuracy even by a simplified measurement, in which the measurement is simplified by measuring only the intervals of the pulse signal that has been transmitted from the electric energy meter.

The fourth object of the present invention is to obtain an air-conditioning apparatus that can measure the consumption of the electric power with high accuracy, even when the pulse signal transmitted from the electric energy meter is disturbed by external noise, by removing the noise portion of the pulse signal and recognizing the pulse signal accurately.

The fifth object of the present invention is to obtain an air-conditioning apparatus, with a multi-outdoor equipment having multiple outdoor units, that can reduce the amount of overall communication by designating a main outdoor unit that coordinates all the electric power so that communication among all the outdoor units will not be required, in which the main outdoor unit will calculate all the electric power, the power consumption, and COP so that a centralized controller will only need to communicate with the main outdoor unit.

Solution to the Problems

An air-conditioning apparatus according to the present invention is an air-conditioning apparatus that has an outdoor unit and an indoor unit, in which the outdoor unit has an electric energy meter with a pulse transmission device that measures the electric energy amount supplied to the outdoor unit, signal reception means for receiving a pulse signal transmitted from the electric energy meter, and control means for measuring the electric energy on the basis of the pulse signal, the control means includes determination means for determining one of input ports that are not in use from among a plurality of input ports forming the signal reception means as an input port for the pulse signal from the electric energy meter, and calculation means for calculating electric power, electric energy consumption, and energy consumption efficiency on the basis of the pulse signal.

Advantageous Effects of Invention

With such a configuration, it is possible to receive the pulse signal from the electric energy meter without the need of a dedicated signal reception circuit, discriminating the control signal from the pulse signal with an existing reception circuit for a control signal. Therefore, it is possible to calculate electric power, electric energy consumption, and energy consumption efficiency on the basis of the pulse signal.

BRIEF DESCRIPTION OF DRAWINGS

FIG. 5A and 5B are a flowchart illustrating operations and processing of the outdoor unit in the air-conditioning apparatus according to Embodiment 1.

DESCRIPTION OF EMBODIMENTS

Embodiments of the present invention will be described below with reference to the drawings.

Embodiment 1.

Figure 1:
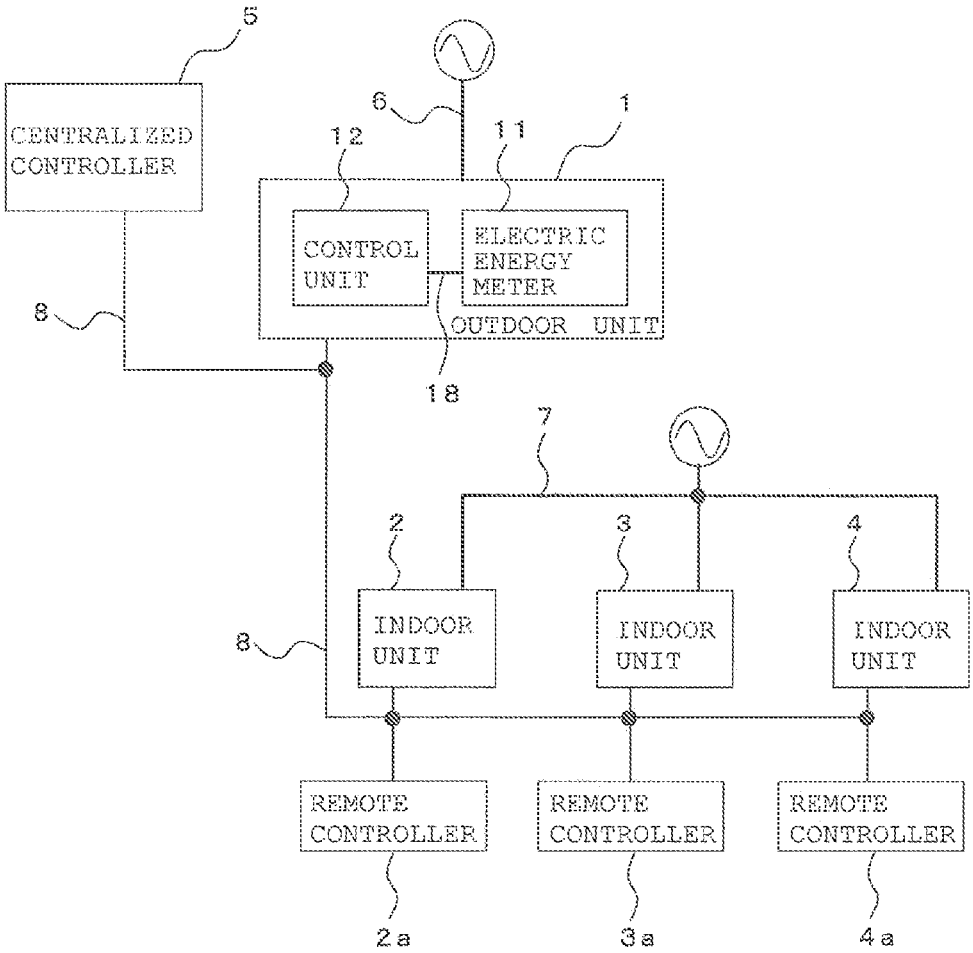
FIG. 1 is a system diagram illustrating the overall configuration of an air-conditioning apparatus according to Embodiment 1 of the present invention.
Figure 2:
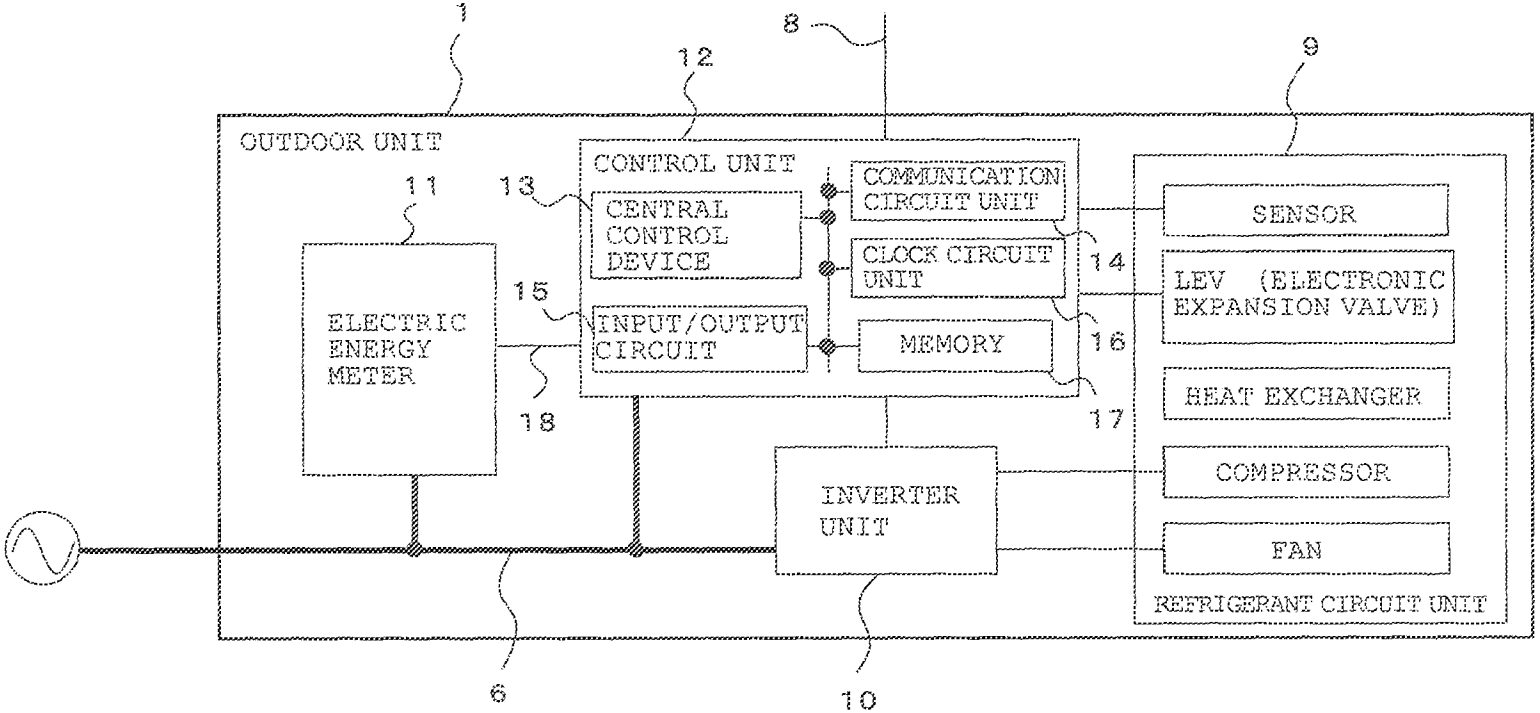
FIG. 2 is a block diagram illustrating the configuration of the outdoor unit in Embodiment 1.

FIG. 1 is a system diagram illustrating the entirety of an air-conditioning apparatus in Embodiment 1 of the present invention, and FIG. 2 is a block diagram illustrating the configuration of the outdoor unit of the air-conditioning apparatus.

In each figure, the air-conditioning apparatus of this embodiment includes an outdoor unit 1, a plurality of (three in this example) indoor units 2, 3, and 4 that are connected to the outdoor unit 1, remote controllers 2*a*, 3*a*, and 4*a*, corresponding to the indoor units 2, 3, and 4, for operating the indoor units 2, 3, and 4, respectively, and a centralized controller 5 for performing management and control of the entire air-conditioning system. The commercial power supply is supplied to the outdoor unit 1 through a power-supply line 6, and the commercial power supply is supplied to the indoor units 2, 3, and 4 through a power-supply line 7. The outdoor unit 1, the indoor units 2, 3, and 4, the remote controllers 2*a*, 3*a*, and 4*a*, and the centralized controller 5 are connected to one another through a transmission line 8. Further, since the outdoor unit 1, the indoor units 2, 3, and 4, the remote controllers 2*a*, 3*a*, and 4*a*, and the centralized controller 5 communicate with one another through the transmission line 8, they have unique numerical address values that does not duplicate.

Furthermore, the outdoor unit 1 is constituted of, all of which are well-known, a refrigerant circuit unit 9 including a sensor (temperature sensor, pressure sensor, etc.), an LEV (electronic expansion valve), a heat exchanger, a compressor, a fan, and the like, an inverter unit 10 that performs frequency control of the rotation speed of the compressor and the fan of the refrigerant circuit unit 9, an electric energy meter 11 having a pulse transmission device, which measures electric energy and transmits a pulse signal (for example, one pulse for every 0.01 kW), and a control unit 12 (example of control means mentioned in CLAIMS). The control unit 12 is constituted of a central control device 13 including such as a microcomputer, a communication circuit unit 14 for communication, an input/output circuit 15 for exchanging control with the refrigerant circuit unit 9, the inverter unit 10, and the electric energy meter 11, a clock circuit unit 16 that measures time, and a memory 17 that stores control states and the like. Furthermore, the electric energy meter 11 and the control unit 12 are connected through a control wiring 18. The above-mentioned 0.01 kW per pulse is electric energy that represents the minimum accuracy of a typical electric energy meter with a pulse transmission device.

Figure 3:
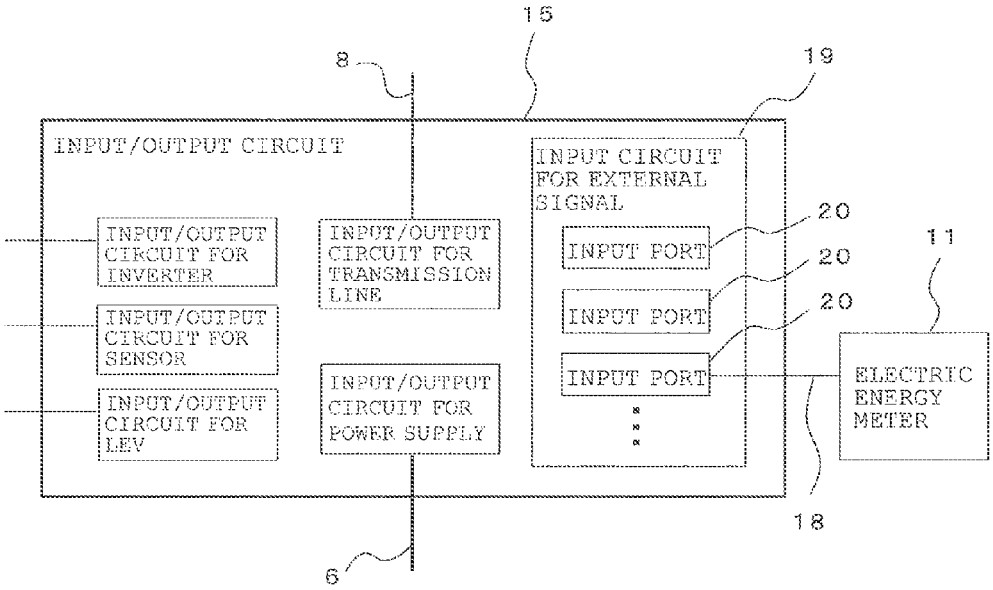
FIG. 3 is a block diagram of an input/output circuit of a control unit of the outdoor unit in Embodiment 1.
Figure 4:
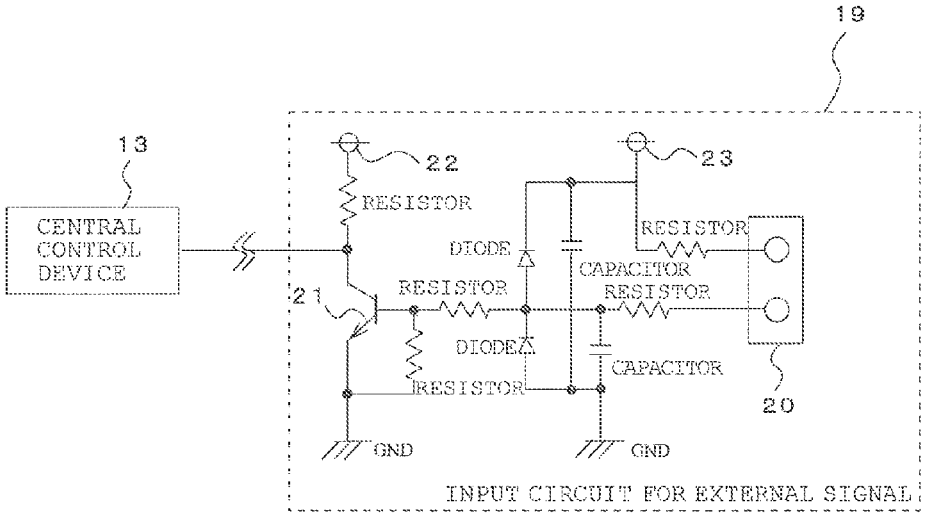
FIG. 4 is a circuit wiring diagram of an input circuit for an external signal of the control unit of the outdoor unit in Embodiment 1.

FIG. 3 is a block diagram of the input/output circuit 15 of the control unit 12 of the outdoor unit 1 in Embodiment 1 of the present invention. FIG. 4 is a circuit wiring diagram of the input circuit 19 for an external signal of the control unit 12 of the outdoor unit 1.

The input/output circuit 15 of the control unit 12 is constituted of an input/output circuit for an inverter, an input/output circuit for a sensor, an input/output circuit for an LEV, an input/output circuit for a transmission line, an input/output circuit for a power supply, and an input circuit 19 for an external signal (example of signal reception means referred to in CLAIMS). The input circuit 19 for an external signal is an input circuit for an operation control signal for additional functions, such as demand (function for performing prohibition control of cooling and heating operation) control, or low noise operation (the noise level is reduced by controlling the maximum fan frequency and the maximum compressor frequency) in accordance with external signals to the outdoor unit 1, and the input circuit 19 generally includes a plurality of signal input ports 20. The input circuit 19 for an external signal is constituted of input ports 20, an FET (Field Effect Transistor) 21, a voltage supply line 22 (for example. supply line of 5 V) for supplying a voltage to the drain of the FET 21, a voltage supply line 23 (for example, supply line of 12 V) for supplying a control voltage, and is connected to an central control device 13 from the drain side of the FET 21. The voltage supply line 22 and the FET 21, the voltage supply line 23 and the input port 20, the input port 20 and the FET 21, the gate and the source of the FET 21 are connected to each other through a resistor, with a capacitor being arranged between the voltage supply line 23 and the GND and between the input port 20 and the GND. Furthermore, a diode is connected between the input port 20 and the voltage supply line 23 and between the input port 20 and the GND.

The electric energy meter 11 with a pulse transmission device is structured to transmit only OPEN/SHORT pulse signal of no voltage using a no-voltage contact (a contact that does not send voltages as signal) for the output circuit, and is connected to the input port 20 that is not in use among the plurality of input ports 20 of the input circuit 19 for an external signal through the control wiring 18. Here, the input port 20 that is not in use refers to, if there is an input port for a control signal that is used to input a driving control signal of the above-mentioned additional function of the outdoor unit 1, an input port that is not in use other than the input port for a control signal. That is, the probability that all the input ports 20 will be actually in use is considerably small. If there is a case in which all are in use, the measurement of electric energy is not necessary because there will be the operation prohibition control.

Next, the operation of the outdoor unit 1 will be described with reference to FIG. 5.

Figure 5A:
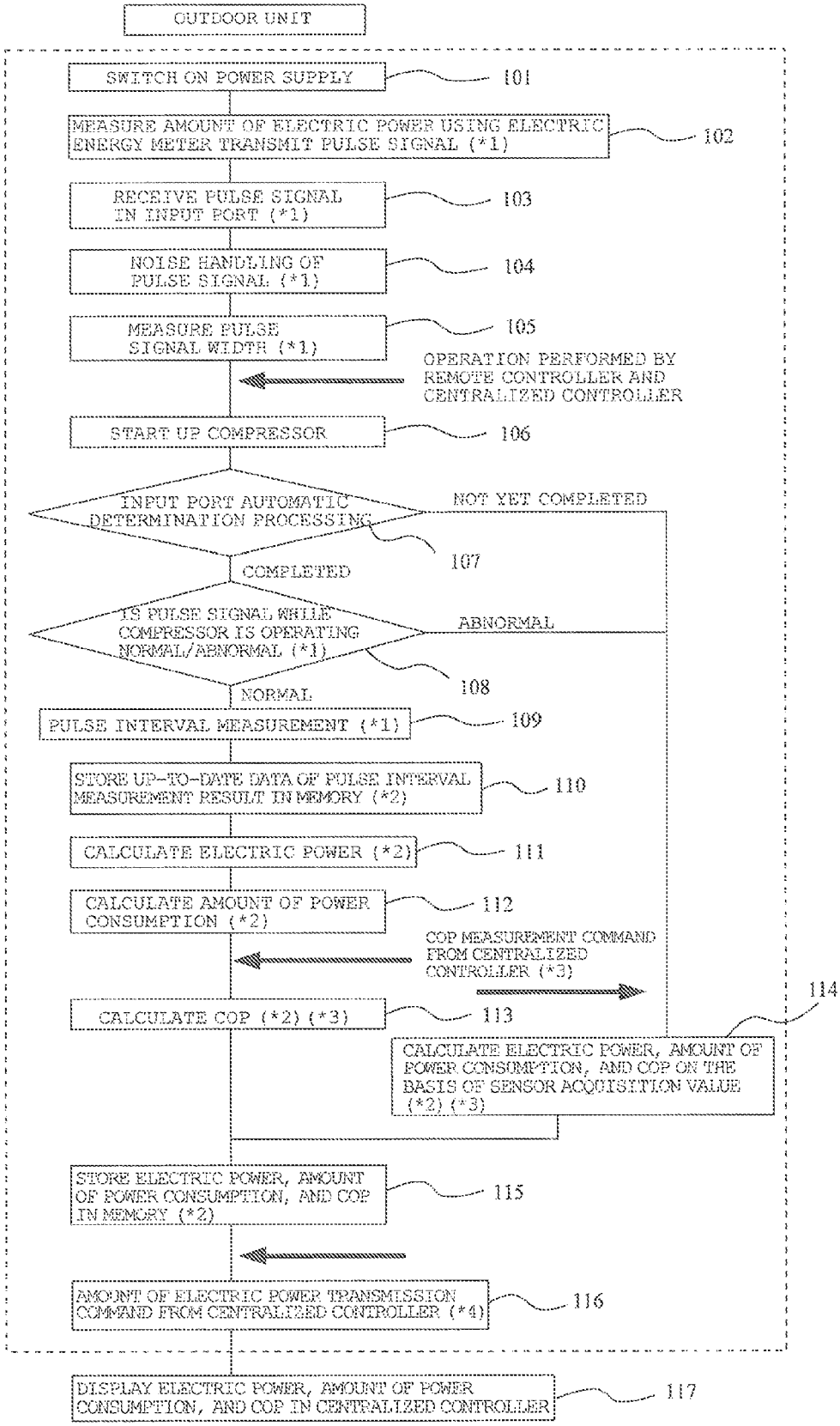

FIG. 5 is a flowchart illustrating operations and processing from when the power supply of the outdoor unit 1 is switched on until electric power, electric energy consumption, and COP are displayed.

When the power supply is switched on in step 101, the commercial power supply is supplied through the power-supply line 6 to the inverter unit 10, the electric energy meter 11, and the control unit 12 of the outdoor unit 1. In step 102, the electric energy meter 11 provided in the outdoor unit 1 measures electric energy that is supplied to the outdoor unit 1, and transmits a pulse signal of a fixed width (for example, 150 msec) each time the measured electric energy reaches a predetermined amount of electric energy (the above-mentioned 0.01 kW). The above-mentioned 150 msec is a value within a range of a pulse signal width (100 to 150 msec) that is transmitted by a typical electric energy meter with a pulse transmission device.

The input circuit 19 for an external signal that is provided as a part of the input/output circuits 15 of the control unit 12 has a plurality of input ports 20 for inputting operation control signals of the mentioned additional function, but these input ports 20 are used only when the additional function is necessary, and the input ports 20 are not in use when the additional function is not necessary. In step 103, the pulse signal from the electric energy meter 11 is transmitted through the control wiring 18, and is received by the input port that is not in use from among the plurality of input ports 20 of the input circuit 19 for an external signal.

The operation control of the additional function is controlled by the ON/OFF (SHORT/OPEN) of the input port 20 of the input port circuit 19 for external signals; when the input port 20 of the input circuit 19 for an external signal is OPEN, the voltage (the above-mentioned 12V) from the voltage line 23 is not supplied to the gate of the FET 21, and the section between the drain and the source of the FET 21 enters an OFF state, thereby the control voltage (the above-mentioned 12V) is not supplied to the central control device 13 and control will not be performed. On the other hand, when the input port 20 is SHORT, the voltage (the above-mentioned 12V) from the voltage line 23 is supplied to the gate of the FET 21, the section between the drain and the source of the FET 21 enters an ON state, and the control voltage (the above-mentioned 12V) that goes around from the gate is supplied to the central control device 13, and as a result, enables the operation control of the additional function (the above-mentioned demand control, low noise driving control, etc.).

Now, reasons why it is possible for the input port for a control signal in the input circuit 19 for an external signal to receive the pulse signal from the electric energy meter 11 will be described.

Since the pulse signal that is transmitted from the electric energy meter 11 are only OPEN/SHORT pulse signal of no voltage, it is possible for the input port 20 of the input circuit 19 for an external signal to receive the pulse signal through the control wiring 18. That is, if the input port 20 is not in use, it is possible for any input port 20 to receive the pulse signal that is transmitted from the electric energy meter 11.

Therefore, it is necessary to determine which input port 20 has received the pulse signal from the electric energy meter 11. This is the automatic determination processing of the input port 20 which will be illustrated in FIG. 6, later on. Before that, first, the following process is performed regarding the pulse signal transmitted from the electric energy meter 11.

In step 104, the central control device 13 of the control unit 12 performs a process of removing noise in the pulse signal so that the pulse signal transmitted from the electric energy meter 11, when received by the input port 20 of the input circuit 19 for an external signal, can be received and recognized with high accuracy even when the pulse signal is disturbed by extrinsic noise.

Now, a noise removal method of the pulse signal will be described. The central control device 13 of the control unit 12 performs scanning on the pulse signal that is received by the input port 20 for a sufficiently short time than the pulse width (2.5 msec, for example). The above 2.5 msec is a sufficiently short value, with respect to the pulse signal width (the above-mentioned 150 msec), capable of recognizing noise, which is the minimum value that the central control device 13 can scan. In the memory 17, 0=<A=<X (X is an arbitrary natural number) is set in advance as a counter variable A, the central control device 13 adds "+1" to the counter variable A when the result of scanning performed on the pulse signal is "Hi" and adds "−1" to the counter variable A when the result of the scanning performed on the pulse signal is "Lo". When the counter variable A becomes "X", the pulse state is determined as "Hi", and when the counter variable A becomes "0", the pulse state is determined as "Lo". When the counter variable A is "X", even if "Hi" is further scanned, the value is maintained as "X", and when the counter variable A is "0", even if "Lo" is further scanned, the value is maintained as "0". Then, cued by a timing when the pulse state changes from "Lo" to "Hi", the central control device 13 starts to measure the pulse width based on the time read on the clock circuit unit. The measurement of the pulse width is completed, cued by a timing when the pulse state changes from "Hi" to "Lo", and is stored in the memory 17 as an up-to-date pulse width value. In the manner described above, the pulse signal is recognized as the portion where the noise is removed while changing from "Lo" to "Hi" and "Hi" to "Lo". Noise removal is performed individually in each of the input ports 20.

Then, when the remote controllers 2*a*, 3*a*, or 4*a*, or the centralized controller 5 issues an instruction and operates the indoor units 2, 3, and 4 to operate in a desired mode, the compressor of the outdoor unit 1 is started up in step 106. When the compressor is started for the first time, an automatic determination processing for the input ports 20 is performed in step 107 to determine which input port among the plurality of input ports 20 of the input circuit 19 for an external signal is receiving the pulse signal.

Now, an automatic determination processing (an example of the determination means referred in CLAIMS) of the input ports 20 will be described with reference to FIG. 6.

Figure 6:
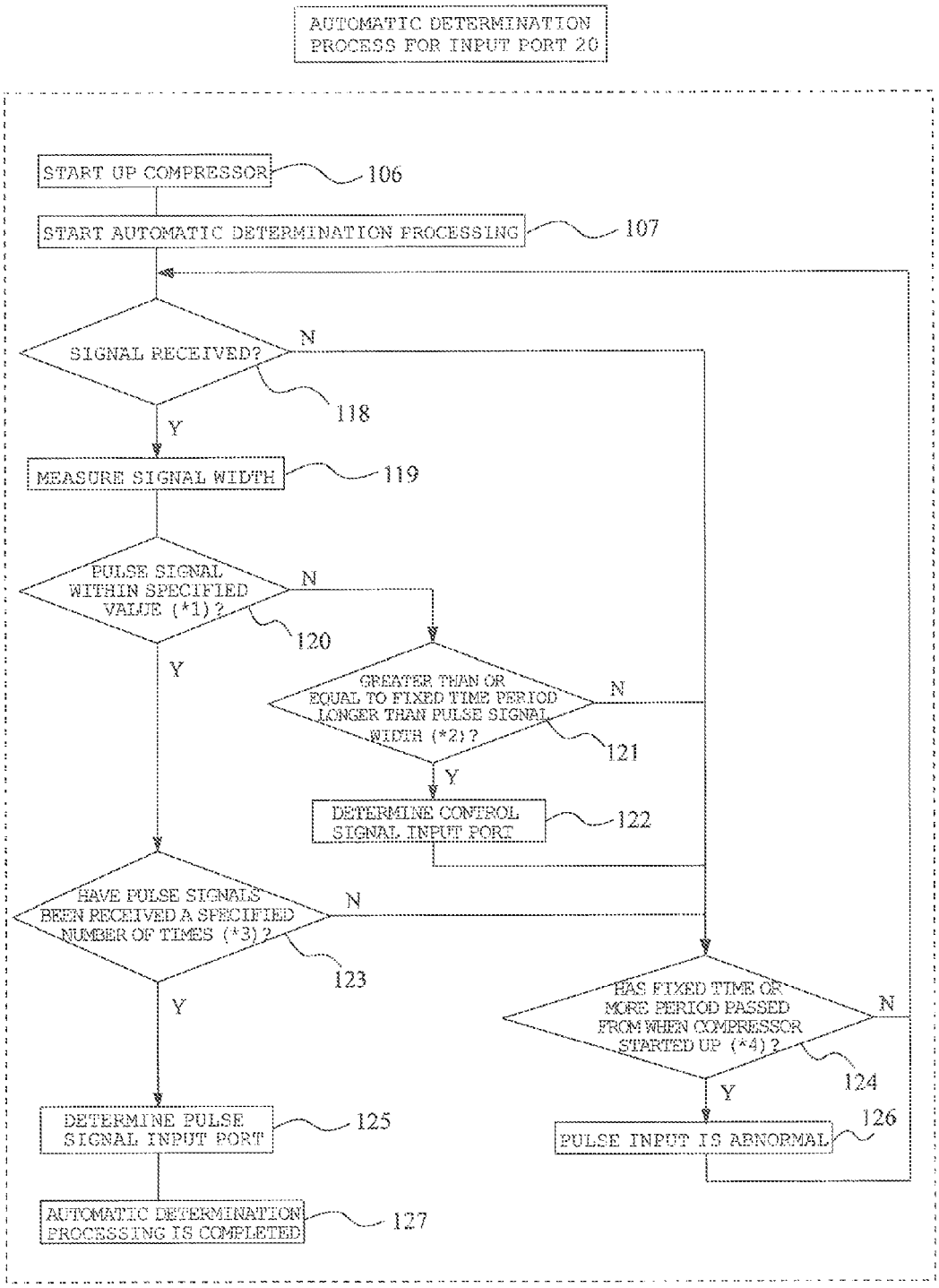
FIG. 6 is a flowchart illustrating operations and processing of an automatic determination processing in an input port of the input circuit for an external signal, of the outdoor unit in Embodiment 1.

FIG. 6 is a flowchart illustrating operations and process of the input ports 20, from the startup of the compressor to the completion of the automatic determination processing.

In step 118, when the external signal is received in all the input ports 20 of the input circuit 19 for an external signal, in step 119, the signal widths thereof are measured. In step 120, the above signal widths are confirmed whether the pulse signal is within the specified value (300 msec, for example) which the above pulse signal width 150 msec can be recognized. When within the specified value (within the above-mentioned 300 msec), in step 123, the input ports 20 are confirmed whether either has received the pulse signal for a specified number of times (two times, for example), which is the number of times that can be reliably recognized, and if it has received the signal for the specified number of times (the above-mentioned two times), then in step 125, the input port 20 is determined as an input port of the pulse signal from the electric energy meter 11.

Further, in step 121, the pulse signal is confirmed whether the "Hi" state has continued for a fixed length of time (for more than one second, for example), which is the width of the control signal that is not a short cycle ON/OFF signal such as the pulse signal width, and if it has continued for a fixed length of time (one second, mentioned above), then in step 122, the port is determined as regular signal input port such as the above-mentioned demand control signal input port or low noise control signal input port. When the above pulse signal input port has been determined, in step 127, the automatic determination processing for input ports 20 is completed. Furthermore, in step 124, the central control device 13 confirms whether a fixed length of time has elapsed (ten minutes, for example) from the startup of the compressor, and if after a fixed length of time (the ten minutes, above mentioned) neither input ports 20 have received an input pulse and the automatic determination processing is not completed, in step 126, pulse input abnormality is determined. When pulse input abnormality is determined, the above-mentioned process is repeated by returning to step 118. The above-mentioned time (above-mentioned ten minutes) should be sufficiently longer than the interval of the pulse signal normally transmitted by the electric energy meter 11 when the compressor is in operation. In general, during the startup of the compressor, there is a pulse approximately once every tens of seconds, so the time should be the time in which it can be recognized a few times which is not too long.

Next, description from the reception of the pulse signal to the calculation of electric power, electric energy consumption and COP will be given, with reference to FIG. 5.

In the manner described above, when the automatic determination processing is completed with the determination of the pulse signal input port of the input circuit 19 for an external signal, if the pulse signal of the compressor during its operation is determined to be normal in step 108, the central control unit of the control unit 12 will, in step 109, measure the pulse interval from the pulse input ON to the next pulse input ON based on the time read by the clock circuit unit 16. In the timing described in the noise removal, when the state of the pulse changes from "Lo" to "Hi", the pulse interval from the preceding pulse is measured and the result is stored as the up-to-date value, and the measurement of the interval with the following pulse is newly started. As for the first one, the pulse interval is 0. Regarding the measurement result of this pulse interval, the up-to-date value is periodically (for example, every 30 sec) stored in the memory 17 in step 110. The above-mentioned 30 sec is a time period during which data is stored in the memory in order to obtain instantaneous electric power; if the pulse interval is too short, the amount of data increases, and if the pulse interval is too long, the number of updated data decreases, and there is a problem in that the number of updates of instantaneous electric power decreases. Here, the period is set in accordance with the periodical intervals of the communication timing of the outdoor unit.

The central control device 13 calculates the hourly electric power, in step 111, by dividing an hour with the pulse interval, which is stored in the memory 17, and multiplying the acquired value by the electric energy per pulse (0.1 kW, above mentioned). In addition, in step 112, the amount of power consumption is calculated by converting the calculated electric power into the amount of electric energy for the measurement interval (thirty seconds, mentioned above) and adding the amount for the time used by the outdoor unit 1. The central control device 13 periodically (the above-mentioned every 30 sec) calculates electric power and electric energy consumption, and stores them in the memory 17 in step 115. Also, the central control device 13, in step 113, calculates the energy consumption efficiency (COP) by dividing the electricity power with the capacity of the outdoor unit 1, based on the measurement start request from the centralized controller 5. Once the measurement is started, the COP is periodically (every thirty seconds, above mentioned) calculated in the same manner as the electric power and the electric energy consumption, and is stored in the memory 17 in step 115.

Once the compressor is started, automatic determination processing of the input ports 20 is performed, and the measurement of the electric power is started by measuring the pulse intervals, the electric power will be continuously measured even if the compressor is stopped. In step 108, during its operation, the compressor confirms whether there is no pulse input consecutively for a fixed length of time (ten minutes, above mentioned), and if there is no pulse input, a pulse input abnormality is determined by the central control device 13. Further, when the compressor changes from a state of operation to a stop, if there is a long interval until the next pulse (the above-mentioned thirty seconds of more in which the measurement is performed), in order to avoid the up-to-date value to be maintained at a large value, the up-to-date value of the electric power is cleared, and a value to be the minimum (40 W, for example) will be set as the up-to-date value of the electric power. That is, the minimum value of 40 W indicates the minimum electric power that will be consumed by the standby power consumption of a CPU and the like, even when the compressor is not in operation.

When the central control amount device 13 determines that the pulse input is abnormal, in step 114, the central control device 13 of the outdoor unit 1 periodically (the above-mentioned every 30 sec) performs the calculation of electric power, electric energy consumption, and COP through calculations on the basis of the value acquired by the sensor included in the related art, and in step 115, the central control device 13 of the outdoor unit 1 periodically (the above-mentioned every 30 sec) stores the calculation results in the memory 17.

The electric power, the electric energy consumption, and COP, which are calculated by the outdoor unit 1, are periodically (the above-mentioned every 30 sec) transmitted to the centralized controller 5 having a display function through the transmission line 8 in step 116. Furthermore, the outdoor unit 1 not only periodically performs the transmission of the electric power, electric energy consumption, and COP, but also transmits the electric power, the electric energy consumption, and COP in response to a request at any desired time from the centralized controller 5.

In the manner described above, according to the air-conditioning apparatus of Embodiment 1, the pulse signal that is output, in step 102, from the electric energy meter 11 with a pulse output which is included is the indoor unit 1, is received by the input port 20 that is not used by the input circuit 19 of external signals in the outdoor unit 1 through the control wiring 18 in step 103, and by only measuring the pulse intervals in step 109, the electric power, the electric energy consumption, and COP are calculated in steps 111, 112, and 113. Therefore, without the need of a special dedicated circuit shown in the related art, by using the input circuit 19 for an external signal of the outdoor unit 1 controlling existing air-conditioning apparatus, it will be possible for the outdoor unit 1 to measure the power consumption, and transmit the result, in step 116, to the centralized controller 5 having a display function periodically or in response to its request. Furthermore, even when the pulse signal from the electric energy meter 11 cannot be received normally by the input ports 20 of the input circuit 19 for an external signal, the central control device 13 determines the pulse input is abnormal, calculates, in step 114, the electric power on the basis of the sensor acquired value that has been possessed until then, and sends the result to the centralized controller 5 in step 116, making it possible to prevent dropout of data of the electric energy.

Embodiment 2.

The above-described Embodiment 1 is configured in such a manner that one outdoor unit calculates electric energy, electric energy consumption, and COP on the basis of the pulse signal of the electric energy meter 11; next, Embodiment 2 using a plurality of outdoor units will be described.

Figure 7:
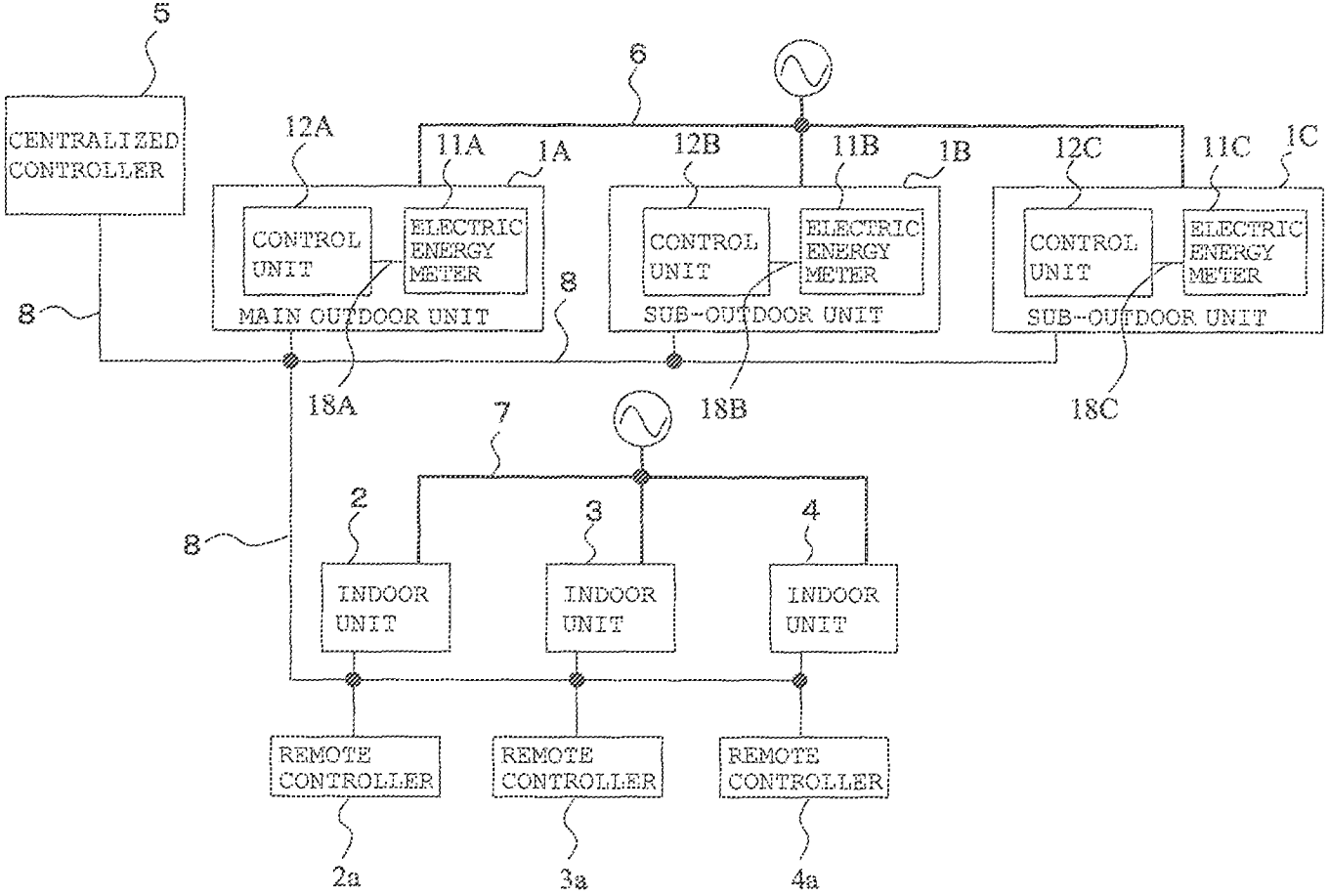
FIG. 7 is a system diagram illustrating the overall configuration of an air-conditioning apparatus according to Embodiment 2 of the present invention.
Figure 8:
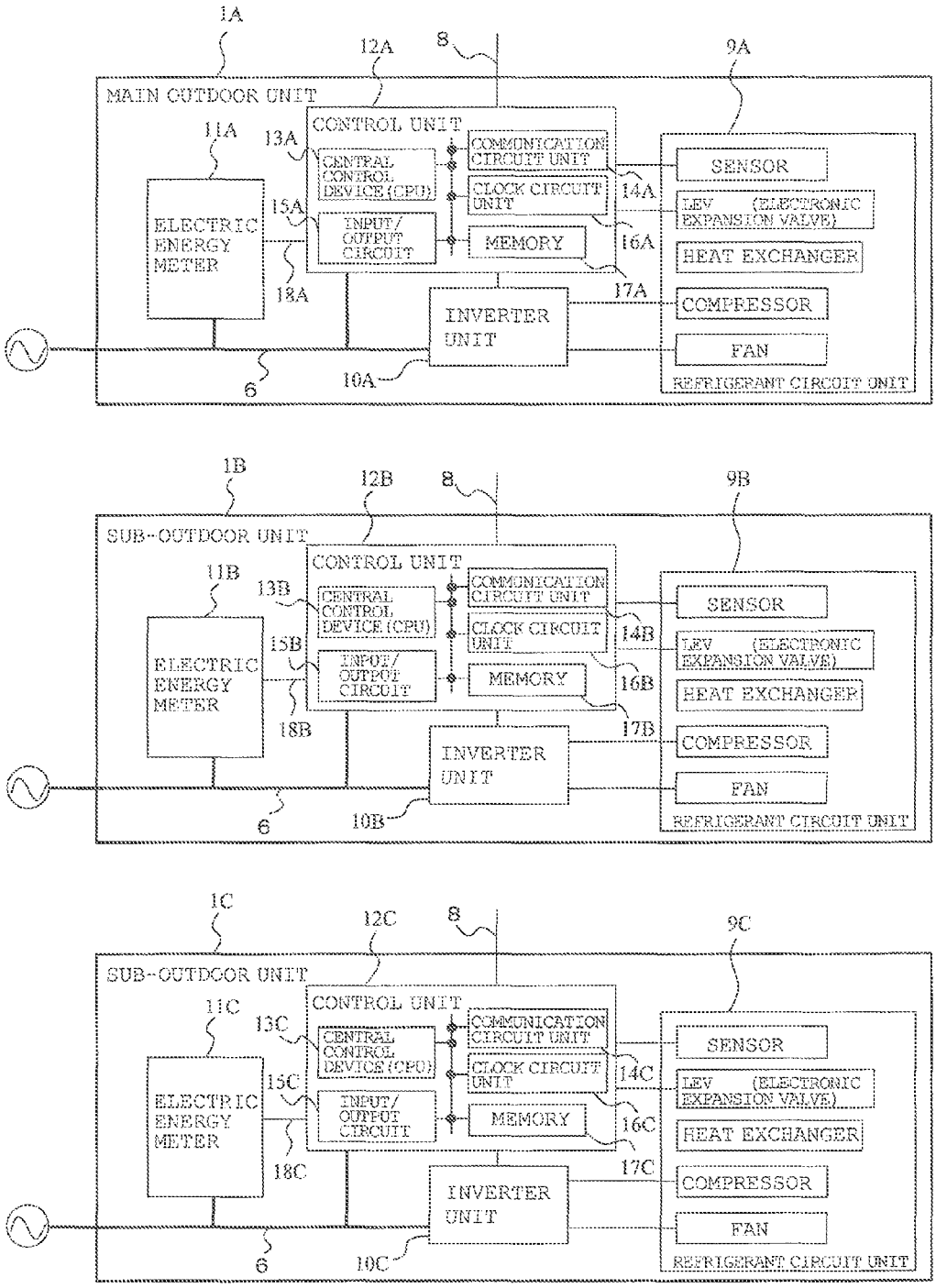
FIG. 8 is a block diagram illustrating the configuration of the outdoor unit in Embodiment 2.

FIG. 7 is a system configuration diagram illustrating the entire air-conditioning apparatus in Embodiment 2 of the present invention. FIG. 8 is a block configuration diagram illustrating the configuration of each outdoor unit.

In each figure, the air-conditioning apparatus of this embodiment has a plurality (three in this example) of outdoor units 1A, 1B, and 1C, a plurality (three in this example) of indoor units 2, 3, and 4, remote controllers 2*a*, 3*a*, and 4*a* corresponding to the indoor units 2, 3, and 4, in which the remote controllers 2*a*, 3*a*, and 4*a* operates the indoor units 2, 3, and 4, respectively, and the centralized controller 5. The commercial power supply is supplied to the outdoor units 1A, 1B, and 1C through the power-supply line 6, and the commercial power supply is supplied to the indoor units 2, 3, and 4 through the power-supply line 7. The outdoor units 1A, 1B, and 1C, the indoor units 2, 3, and 4, the remote controllers 2*a*, 3*a*, and 4*a*, and the centralized controller 5 are connected to one another through the transmission line 8. Further, since the outdoor units 1A, 1B, and 1C, the indoor units 2, 3, and 4, the remote controllers 2*a*, 3*a*, and 4*a*, and the centralized controller 5 communicate with one another through the transmission line 8, they have unique numerical address values that does not duplicate, and the outdoor units 1A, 1B, and 1C are classified into a main outdoor unit or sub-outdoor units depending on their numerical address values and the capability of the units 1A, 1B, and 1C. Here, the outdoor unit 1A is classified as a main outdoor unit, and the outdoor units 1B and 1C are classified as sub-outdoor units.

In addition, the outdoor units 1A to 1C, as each of which is described in Embodiment 1, are constituted of, all of which are well-known, refrigerant circuit units 9A to 9C including a sensor, an LEV (linear electronic expansion valve), a heat exchanger, a compressor, and a fan, inverter units 10A to 10C for performing frequency control of the rotation speed of the compressors and the fans of the refrigerant circuit units 9A to 9C, electric energy meters 11A to 11C with transmission devices, which measure electric energy and transmit a pulse signal, and control units 12A to 12C, respectively. The control units 12A to 12C are constituted of central control devices 13A to 13C including a microcomputer and the like, communication circuit units 14A to 14C for performing communication, input/output circuits 15A to 15C for performing control to and from the refrigerant circuit units 9A to 9C, the inverter units 10A to 10C, and the electric energy meters 11A to 11C, clock circuit units 16A to 16C for measuring time, and memories 17A to 17C for storing the control state and the like, respectively. Furthermore, the electric energy meters 11A to 11C and the control units 12A to 12C are connected to each other through control wirings 18A to 18C, respectively.

Figure 9:
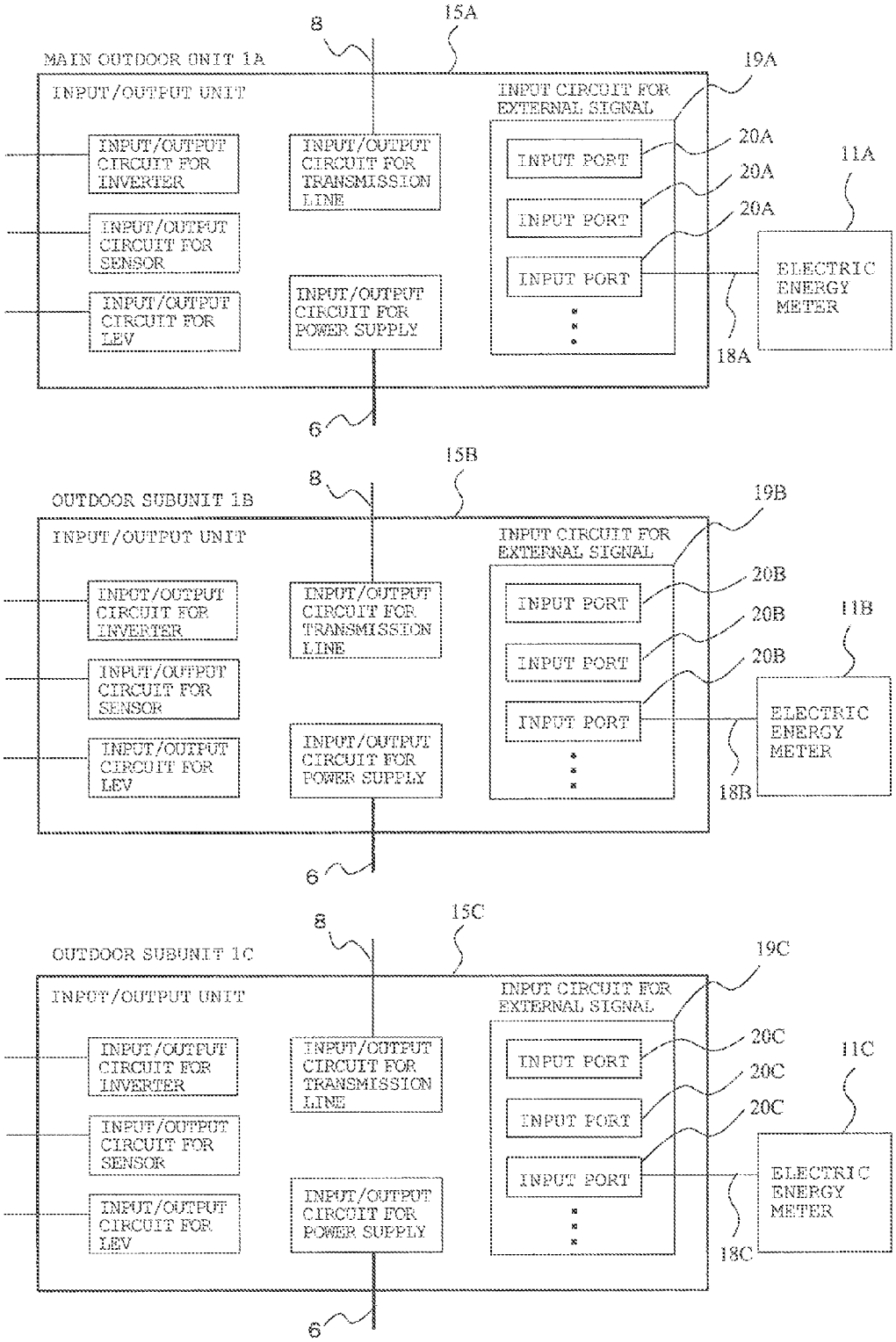
FIG. 9 is a block diagram of an input/output circuit of a control unit of the outdoor unit in Embodiment 2.

FIG. 9 illustrates block diagrams of input/output circuits 15A to 15C of the control units units 12A to 12C of the outdoor units 1A to 1C in Embodiment 2 of the present invention.

The input/output circuits 15A to 15C of the control units 12A to 12C are, respectively, constituted of an input/output circuit for an inverter, an input/output circuit for a sensor, an input/output circuit for an LEV, an input/output circuit for a transmission line, an input/output circuit for a power supply, and input circuits 19A to 19C for external signals, in which the input circuits 19A to 19C for external signals have a plurality of signal input ports 20A to 20C. The respective circuit diagrams of the input circuits 19A to 19C for external signals are as shown in FIG. 4. Pulse signals from the electric energy meters 11A to 11C are transmitted through the control wirings 18A to 18C, and are received by input ports that are not in use from among the plurality of input ports 20A to 20C of the input circuits 19A to 19C for external signals.

Figure 10:
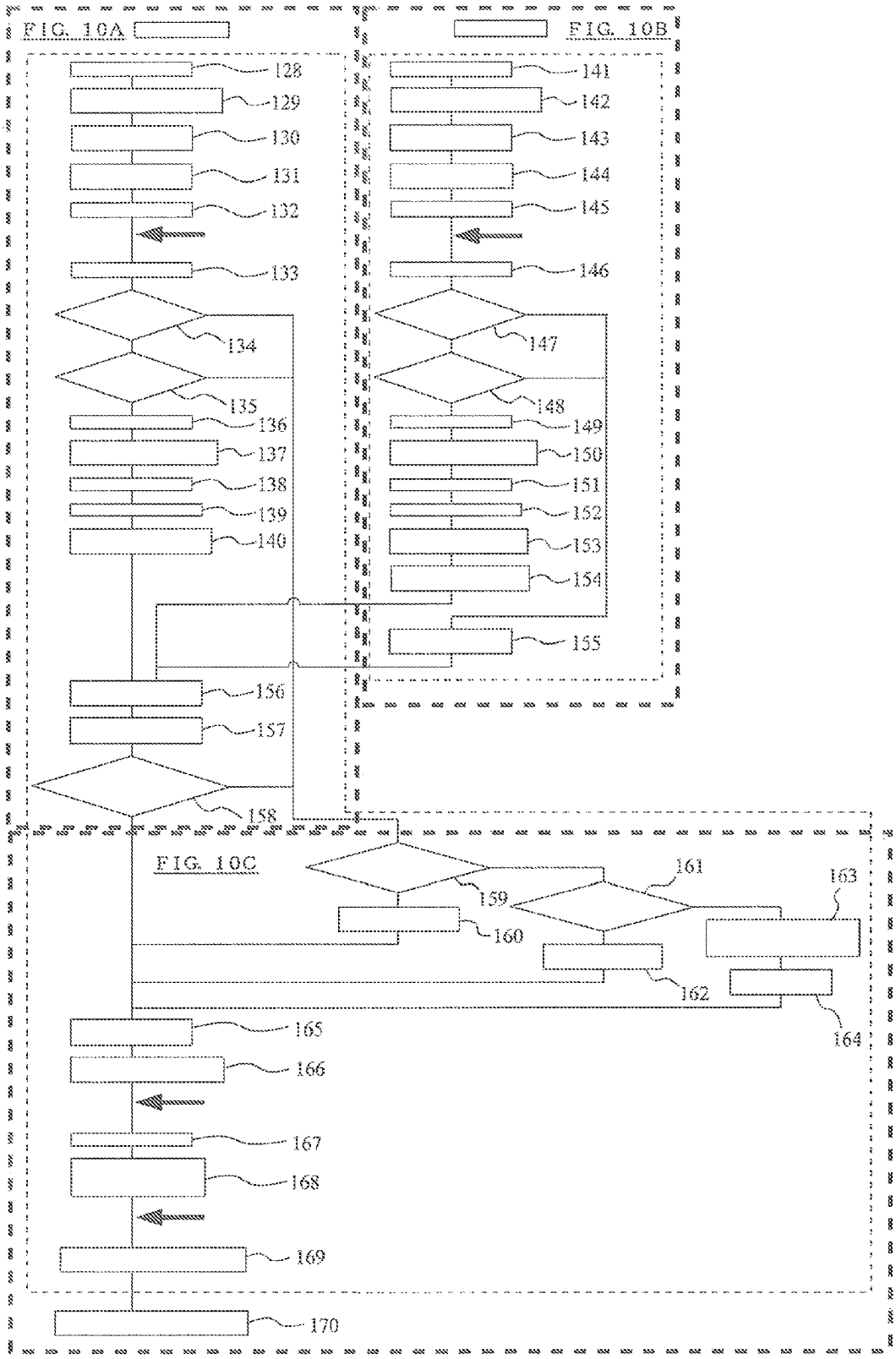
FIGS. 10 and 10A-10C are a flowchart illustrating operations and processing of the outdoor unit in the air-conditioning apparatus according to Embodiment 2.
Figure 10A:
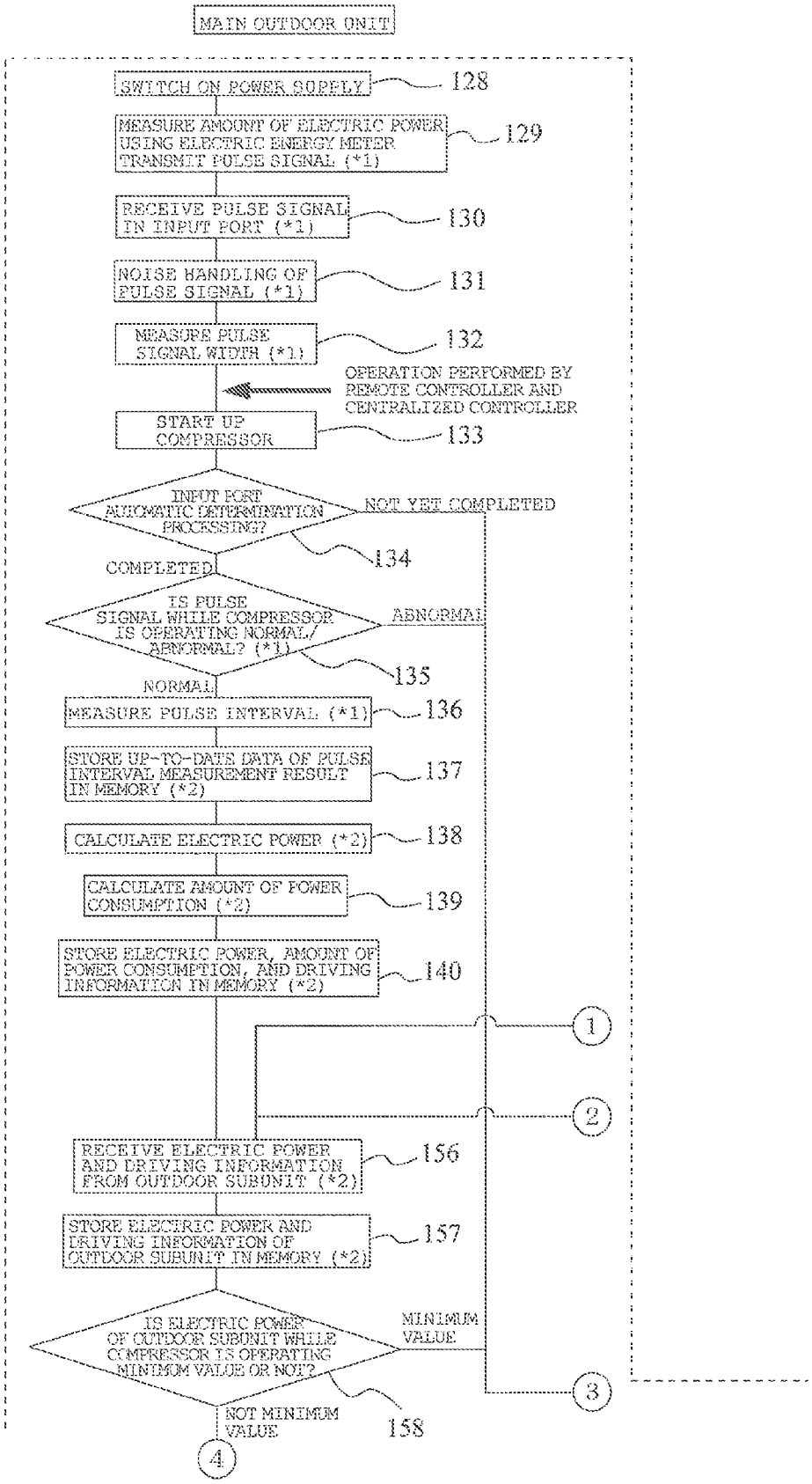
Figure 10B:
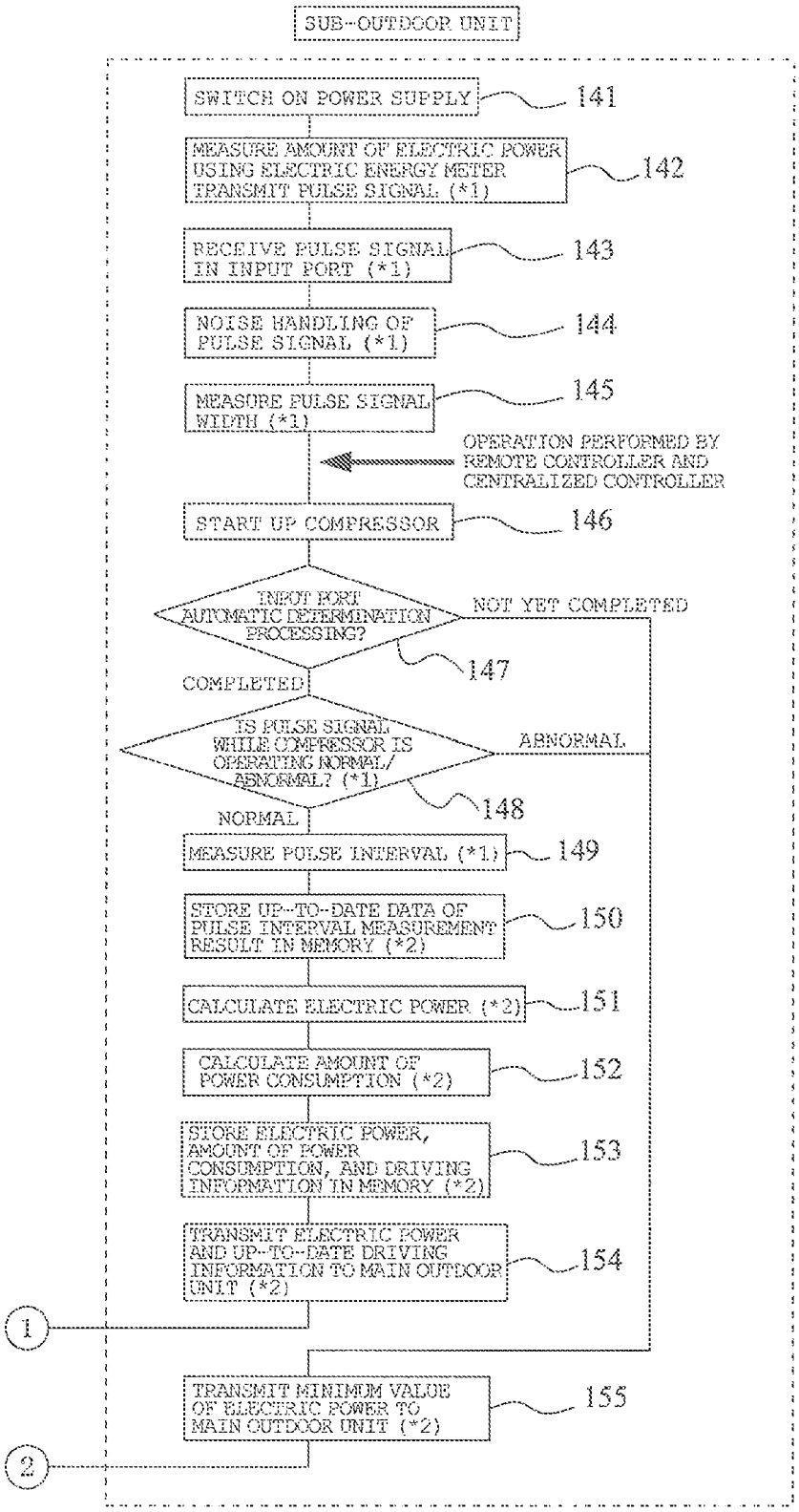
Figure 10C:
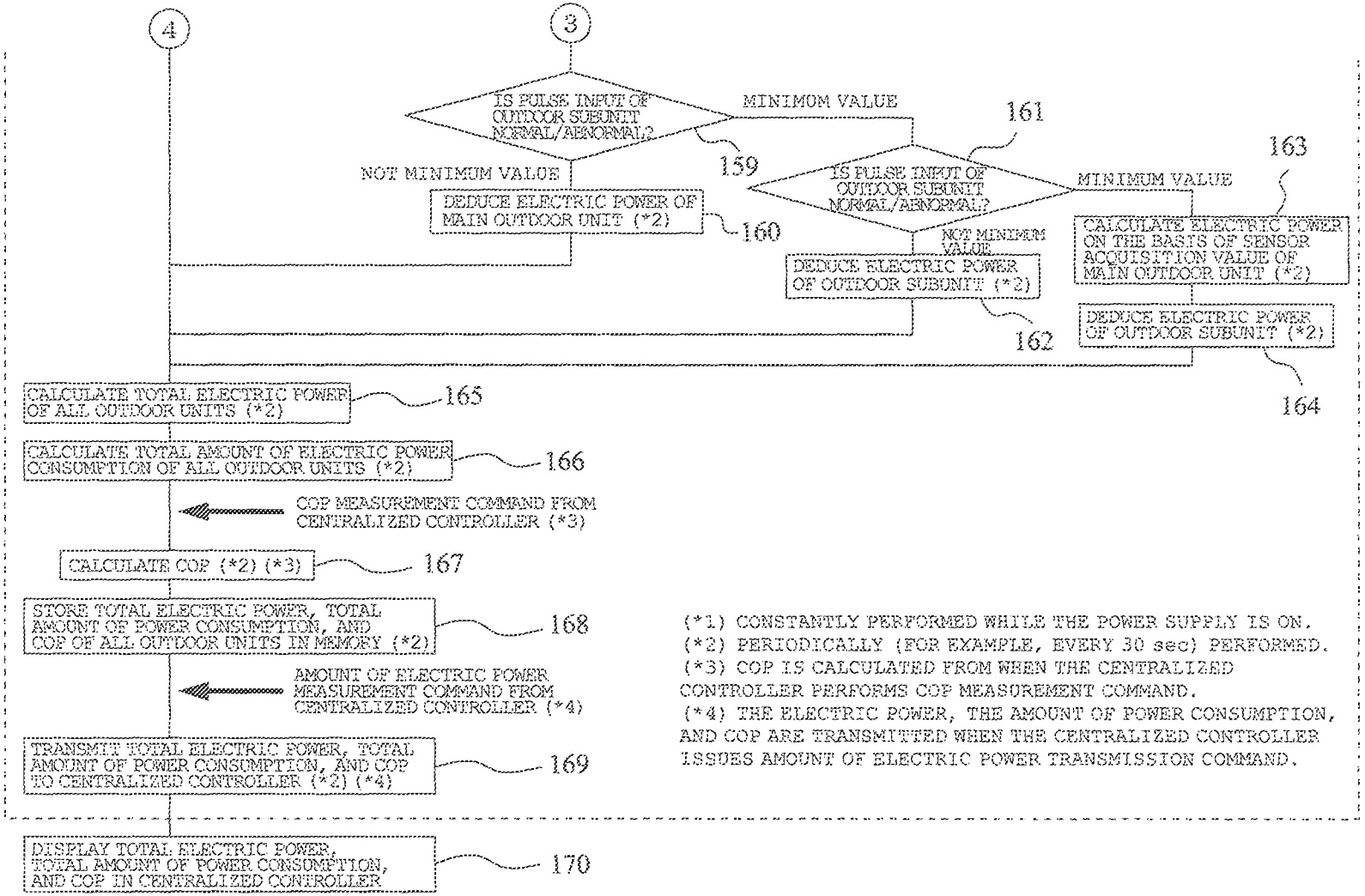

Next, description of operations will be given FIG. 10 is a flowchart illustrating operations and processing from when the power supplies of the outdoor units 1A to 1C are switched on until electric power, electric energy consumption, and COP are displayed.

When the power supplies of the main outdoor unit 1A and the sub-outdoor units 1B and 1C are switched on in steps 128 and 141, the commercial power supply is supplied to the inverter units 10A to 10C, the electric energy meters 11A to 11C, and the control units 12A to 12C of the outdoor units 1A to 1C through the power-supply line 6. In steps 129 and 142, the electric energy meters 11A to 11C provided in the outdoor units 1A to 1C, respectively, measure electric energy that is supplied to the respective outdoor units, and transmit a pulse signal of a fixed width (the above-mentioned 150 msec) each time the measured electric energy reaches a predetermined amount of electric energy (the above-mentioned 0.01 kW). In accordance with the method described in Embodiment 1, on the basis of the pulse signal from the electric energy meters 11A to 11C included in the outdoor units 1A to 1C, respectively, their individual electric powers and electric energy consumptions are calculated and stored in the memories 17A to 17C, respectively, in steps 130 to 140 and in steps 143 to 153. Furthermore, the outdoor units 1A to 1C periodically (the above-mentioned every 30 sec) store their respective operation information (the frequency of the compressor, etc.) in the memories 17A to 17C in steps 140 and 153.

In step 154, the central control devices 13B and 13C of the sub-outdoor units 1B and 1C transmit the measured electric powers to the main outdoor unit 1A periodically (the above-mentioned every 30 sec) through the transmission line 8. When the pulse signal input ports of the sub-outdoor units 1B and 1C are not determined, when the pulse signal is not received, the central control devices 13B and 13C of the sub-outdoor units 1B and 1C transmit a minimum electric energy value (the above-mentioned 40 W) to the main outdoor unit 1A in step 155. Furthermore, in step 154, the central control devices 13B and 13C of the sub-outdoor units 1B and 1C periodically (the above-mentioned every 30 sec) transmit their respective operation information (the frequency of the compressor, etc.) stored in the memories 17B and 17C in step 153 to the main outdoor unit 1A through the communication circuit units 14B and 14C and the transmission line 8.

In step 156, the central control device 13A of the main outdoor unit 1A receives the electric powers from the sub-outdoor units 1B and 1C and also the operation information of the sub-outdoor units 1B and 1C, and individually stores the electric powers and the operation information of the sub-outdoor units 1B and 1C in a memory 17A in step 157. In step 158, the central control device 13A of the main outdoor unit 1A confirms whether or not the electric energies from the sub-outdoor units 1B and 1C, while the compressors are operating, are minimum values, and when a minimum electric energy value (the above-mentioned 40 W) is continuously received for a certain period of time (the above-mentioned 10 minutes) in spite of the fact that the compressors of the sub-outdoor units 1B and 1C are operating, the central control device 13A determines that the pulse inputs of the sub-outdoor units 1B and 1C are abnormal. Furthermore, when the pulse signal input port of the main outdoor unit 1A is not determined or when the pulse signal is not received, in accordance with the method described in Embodiment 1, in steps 134 and 135, the central control device 13A of the main outdoor unit 1A determines that the pulse input of the main outdoor unit 1A is abnormal.

When the central control amount device 13A of the main outdoor unit 1A determines that the pulse input of the main outdoor unit 1A is abnormal, it is determined in step 159 whether or not both the pulse inputs of the sub-outdoor units 1B and 1C are normal, and when it is determined that both the pulse inputs of the sub-outdoor units 1B and 1C are normal, in step 160, from the operation information and the electric power of the sub-outdoor units 1B and 1C, the central control device 13A of the main outdoor unit 1A deduces and calculates the electric power of the main outdoor unit 1A on the basis of the operation information of the main outdoor unit 1A, which is stored in the memory 17A. Similarly, when it is determined in step 161 that the pulse input of either of the sub-outdoor nits 1B or 1C, or both of them is abnormal, based on the operation information and the electric power of the main outdoor unit 1A, in step 162, the electric power of the sub-outdoor units 1B and 1C whose pulse input is abnormal, is deduced and calculated on the basis of the operation information of the sub-outdoor units 1B and 1C whose pulse input is abnormal, which is stored in the memory 17A.

Furthermore, when the pulse inputs of all the outdoor units 1A to 1C are abnormal in step 161, the main outdoor unit 1A deduces and calculates the electric powers of the sub-outdoor units 1B and 1C, in step 164, by performing measurement through calculating the electric power with the obtained value of the sensor, which is provided as a related art, and by the result and the operation information of the sub-outdoor units 1B and 1C.

In step 165, the central control device 13A of the main outdoor unit 1A calculates the total of the electric powers of the outdoor units 1A to 1C by adding the electric powers acquired from the sub-outdoor units 18 and 1C and the electric power of the main outdoor unit 1A. When either one of the main outdoor unit 1A and the sub-outdoor units 1B and 1C has an abnormal pulse input, the total of all electric power is calculated by adding the electric power that is normally calculated from the pulse signal and the electric power of the outdoor unit whose pulse input is abnormal, which is deduced from the operation information. When all the outdoor units 1A to 1C are abnormal, the total of all electric power is calculated by adding the electric power calculated on the basis of the sensor acquisition value of the main outdoor unit 1A and the electric power of the sub-outdoor units 1B and 1C, which are deduced on the basis of the operation information.

The total electric energy consumption of the outdoor units 1A to 1C is calculated by converting the total electric power of the main outdoor unit 1A and the sub-outdoor units 1B and 1C, calculated in step 165, into the amount of electric energy for the amount of interval (the above-mentioned 30 sec), which is measured in step 166, and adding the amount for the time used by all the outdoor units 1A to 1C. Each time the total electric power and the total electric energy consumption are calculated in step 168, the central control device 13A of the main outdoor unit 1A stores them in the memory 17A. Furthermore, in step 167, the energy consumption efficiency (COP) is collected by dividing the total capacity of the outdoor units 1A to 1C by the total electric power, and is stored in the memory 17A. The measurement of COP is started by a measurement start request made from the centralized controller 5 to the outdoor unit 1A, and the COP is calculated periodically (the above-mentioned every 30 sec) in the same manner as for the electric power and the amount of power consumption, and is stored in the memory 17A in step 168.

In step 169, the total electric power, the amount of power consumption, and COP, which are calculated by the main outdoor unit 1A in steps 165, 166, and 167, are transmitted periodically (every 30 sec above) to the centralized controller 5 having a display function through the transmission line 8. Furthermore, the main outdoor unit 1A not only periodically transmits the electric power, electric energy consumption, and COP, but also transmits the electric power, the electric energy consumption, and COP in response to a request from the centralized controller 5 at any desired time.

In the manner described above, according to the air-conditioning apparatus of Embodiment 2, in steps 132 and 145, the outdoor units 1A to 1C measure the interval of the pulse signal transmitted from the electric energy meters 11A to 11C with a pulse transmission device, which are included in the outdoor units 1A to 1C, respectively, in steps 129 and 142, thereby individually calculating the electric power and the amount of power consumption in steps 138 and 139 and in steps 151 and 152. Then, in step 154, the sub-outdoor units 1B and 1C transmit the electric power to the main outdoor unit 1A through the transmission line 8, in step 156, the main outdoor unit 1A collects the electric power, and in steps 165, 166, and 167, calculates the total electric power, the electric energy consumption, and COP. Therefore, even in the case of a plurality of outdoor units, it is possible to calculate the individual electric power and the individual electric energy consumption of the outdoor units 1A to 1C, and as a result of the main outdoor unit 1A organizing the electric powers of the sub-outdoor units 1B and 1C in step 156, it is possible to calculate the total electric power, the total amount of power consumption, and COP, thereby making it possible to transmit the result to the centralized controller 5 having a display function periodically or in response to a request in step 169.

Furthermore, in one of the outdoor units 1A to 1C, even when the pulse signal from the electric energy meters 11A to 11C cannot be normally received by the input ports 20A to 20C of the input circuits 19A to 19C for external signals, the central control device 13A of the main outdoor unit 1A determines that the pulse input of each of the outdoor units 1A to 1C is abnormal, deduces and calculates the electric power of the outdoor unit whose pulse input is abnormal on the basis of the operation information of the outdoor unit whose pulse input abnormal, the operation information and the electric powers of the other normal outdoor units, and transmits the total electric power to the centralized controller 5 in step 169, making it possible to prevent the data dropout of the electric energy.

Furthermore, even if a pulse input abnormality occurs in all the outdoor units, the main outdoor unit 1A calculates the electric power through calculations on the basis of the value acquired by the sensor that has hitherto been possessed, deduces and calculates the electric power of the sub-outdoor units 1B and 1C on the basis of the operation information of the sub-outdoor units 1B and 1C and the operation information of the main outdoor unit 1A, and transmits the total electric power to the centralized controller 5 in step 169, thereby making it possible to prevent the data dropout of the electric energy.

Although in the above-described description, a case in which the present invention includes a plurality of outdoor units, and the electric powers of the sub-outdoor units are organized by a main outdoor unit has been described, needless to say, the present invention can be used for a case in which an electric energy meter is included in each of a plurality of indoor units, and the total electric power is organized by a main outdoor unit using the same procedure as for the sub-outdoor units.

Although in the above-described description, the role of organizing electric power is performed by the main outdoor unit that is determined on the basis of the capacity by an outdoor unit and an address, needless to say, an intended object can be achieved even if any one of the sub-outdoor units organizes electric power and calculates all the electric power, the amount of power consumption, and COP.

REFERENCE SIGNS LIST

1 outdoor unit, 1A main outdoor unit, 1B, 1C sub-outdoor unit, 2, 3, 4 indoor unit, 2*a*, 3*a*, 4*a* remote controller, 5 centralized controller, 6, 7 power-supply line, 8 transmission line, 9, 9A, 9B, 9C refrigerant circuit unit, 10, 10A, 10B, 10C inverter unit, 11, 11A, 11B, 11C electric energy meter, 12, 12A, 12B, 12C control unit, 13, 13A, 13B, 13C central control device, 14, 14A, 14B, 14C communication circuit unit, 15, 15A, 15B, 15C input/output circuit, 16, 16A, 16B, 16C clock circuit unit, 17, 17A, 17B, 17C memory, 18, 18A, 18B, 18C control wiring, 19, 19A, 19B, 19C input circuit for an external signal, 20, 20A, 20B, 20C input port, 21 FET, 22, 23 voltage supply line.

The invention claimed is:

1. An air-conditioning apparatus, comprising:

an outdoor unit and an indoor unit, in which said outdoor unit includes:

an electric energy meter with a pulse transmission device that measures the electric energy amount supplied to the outdoor unit, signal reception means for receiving a pulse signal transmitted from the electric energy meter, and control means for measuring said electric energy on the basis of said pulse signal, wherein said control means includes determination means for determining from among a plurality of input ports forming said signal reception means, one input port that is not in use by other signals, and the one input port that is not in use is used determined and as an input port for the pulse signal from said electric energy meter, and calculation means for calculating electric power, electric energy consumption, and energy consumption efficiency on the basis of said pulse signal.

2. The air-conditioning apparatus of claim 1, wherein said control means of said outdoor unit includes means for determining, when the pulse signal from said electric energy meter with a pulse transmission device is input for a specified plurality of times on an input port, the input port as an input port for receiving the pulse signal.

3. The air-conditioning apparatus of claim 1, wherein said control means of said outdoor unit measures only a pulse interval of the pulse signal transmitted from said electric energy meter with a pulse transmission device and calculates electric power, electric energy consumption, and coefficient of performance.

4. The air-conditioning apparatus of claim 1, wherein said control means of said outdoor unit includes means for removing noise of the pulse signal transmitted from said electric energy meter with a pulse transmission device.

5. The air-conditioning apparatus of claim 1, wherein, in a case in which said signal reception means cannot receive said pulse signal, when said control means of said outdoor unit determines that a pulse input is abnormal, said control means calculates electric power, electric energy consumption, and energy consumption efficiency on the basis of a value acquired by a sensor possessed by said outdoor unit.

6. An air-conditioning apparatus, comprising:

a plurality of outdoor units and a plurality of indoor units, each of the outdoor units including:

an electric energy meter with a pulse transmission device, the electric energy meter measuring electric energy supplied to the outdoor unit, signal reception means for receiving a pulse signal transmitted from the electric energy meter, and control means for measuring said electric energy on the basis of said pulse signal, wherein the control means of each outdoor unit includes determination means for determining, from among a plurality of input ports forming the signal reception means, one input port which is not in use by other signals, and the one input port that is not in use is determined and used as an input port for the pulse signal from the electric energy meter, and calculation means for calculating electric power, electric energy consumption, and energy consumption efficiency on the basis of the pulse signal, and wherein the control means of an outdoor unit serving as a main unit organizes electric power of outdoor units serving as subunits and calculates the total electric power, electric energy consumption, and energy consumption efficiency.

7. The air-conditioning apparatus of claim 6, wherein in the air-conditioning apparatus having said plurality of outdoor units, in a case where there is an outdoor unit that cannot receive the pulse signal from said electric energy meter with a pulse transmission device, an outdoor unit that has successfully received the pulse signal from other electric energy meter with the pulse transmission device has means for calculating the electric power of said outdoor unit that cannot receive the pulse signal.

8. An air-conditioning apparatus, comprising:

an outdoor unit and an indoor unit, in which said outdoor unit includes:

an electric energy meter with a pulse transmission device that measures the electric energy amount supplied to the outdoor unit, a signal reception unit configured to receive a pulse signal transmitted from the electric energy meter, and a control unit configured to measure said electric energy on the basis of said pulse signal, wherein said control unit includes a determination unit that determines from among a plurality of input ports forming said signal reception unit, one input port that is not in use by other signals, and the one input port that is not in use is determined and used as an input port for the pulse signal from said electric energy meter, and a calculation unit that calculates electric power, electric energy consumption, and energy consumption efficiency on the basis of said pulse signal.

* * * * *